US008052259B2

(12) United States Patent
Sulser et al.

(10) Patent No.: US 8,052,259 B2
(45) Date of Patent: Nov. 8, 2011

(54) INK CARTRIDGE

(75) Inventors: Daniel Sulser, Wald (CH); Roland Steiner, Eschenbach (CH); André Huber, Wettingen (CH)

(73) Assignee: Pelikan Hardcopy Production AG, Egg (CH)

( * ) Notice: Subject to any disclaimer, the term of this patent is extended or adjusted under 35 U.S.C. 154(b) by 547 days.

(21) Appl. No.: 12/249,011

(22) Filed: Oct. 10, 2008

(65) Prior Publication Data

US 2009/0096850 A1 Apr. 16, 2009

(30) Foreign Application Priority Data

Oct. 10, 2007 (DE) ..... 10 2007 048 819

(51) Int. Cl.
*B41J 2/175* (2006.01)

(52) U.S. Cl. ..... 347/86; 347/87

(58) Field of Classification Search ..... 347/85–87
See application file for complete search history.

(56) References Cited

U.S. PATENT DOCUMENTS

| | | | | |
|---|---|---|---|---|
| 5,706,040 | A * | 1/1998 | Reid et al. | 347/50 |
| 6,000,773 | A * | 12/1999 | Murray et al. | 347/7 |
| 6,378,984 | B1 * | 4/2002 | Steinfield et al. | 347/47 |
| 6,378,985 | B2 * | 4/2002 | McArdle et al. | 347/49 |
| 7,465,021 | B2 * | 12/2008 | Toge et al. | 347/50 |
| 7,669,993 | B2 * | 3/2010 | Hashii et al. | 347/86 |
| 2005/0030340 | A1 | 2/2005 | Shinada | |
| 2007/0222838 | A1 | 9/2007 | Wanibe | |

FOREIGN PATENT DOCUMENTS

| | | |
|---|---|---|
| EP | 0710568 | 7/1996 |
| EP | 1547786 | 6/2005 |
| EP | 1247651 | 7/2005 |
| GB | 2436542 | 10/2007 |

* cited by examiner

*Primary Examiner* — Ellen Kim
(74) *Attorney, Agent, or Firm* — Volpe and Koenig, P.C.

(57) ABSTRACT

Ink cartridge (10) which is insertable (insertion direction 11) into an inkjet printer, or cartridge receptacle associated therewith, and which has a housing (13) on at least one wall (12) of which there is arranged a plate (21) comprising electrical contacts (20) and an element for storage of cartridge-specific and/or printer-specific data. The housing (13) is delimited by two side walls (17, 18), a top wall (15), a base wall (16) and a front and rear (end) wall (12, 14). At least that portion (12') of the housing wall, especially of an end wall (12), which is associated with the plate (21) has a smaller width than the plate (21). The latter is, in addition, mounted to allow its movement transversely to the longitudinal extent of the associated housing wall (12), or transversely to the insertion direction (11) of the cartridge (10) (double-headed arrow 24).

5 Claims, 2 Drawing Sheets

INK CARTRIDGE

CROSS-REFERENCE TO RELATED APPLICATIONS

This application claims the benefit of DE 10 2007 048 819.1, filed Oct. 10, 2007, which is incorporated herein by reference as if fully set forth.

BACKGROUND

The present invention relates to an ink cartridge which is insertable into an inkjet printer, or cartridge receptacle associated therewith. In this context it should be mentioned that the cartridge receptacle is usually part of a carriage mounted for reciprocating movement inside the printer.

Ink cartridges of such a kind are generally known; mention is made, solely by way of example, of EP 1 247 651 B1. It is a feature of those known ink cartridges that the plate comprising electrical contacts and a means for storage of cartridge-specific and/or printer-specific data is fixed in its connection to the housing of the ink cartridge. The ink cartridge and the plate must therefore be manufactured to fit exactly, in order to ensure that the ink cartridge can be inserted into the cartridge receptacle without forcing. The electrical contacts both on the plate and also on that boundary wall of the cartridge receptacle which faces the plate are arranged offset from one another not only transversely but also in the cartridge insertion direction, so that if the ink cartridge is not properly inserted into the associated receptacle incorrect electrical connections may be made, especially in the direction parallel to the insertion direction.

SUMMARY

The present invention is designed to address the above-mentioned problems, that is to say of making available an ink cartridge which, even when relatively large manufacturing tolerances are present, allows the cartridge-specific contacts to be exactly aligned with the printer-specific contacts.

This is done with an ink cartridge according to the invention, with advantageous embodiments and constructional details being described below.

In accordance with the invention, the plate is of slightly wider construction and, in accordance with an advantageous embodiment, is so mounted on a slightly narrower ink cartridge that the plate can, by itself, align itself directly in the guideway of the printer or cartridge receptacle relative to the printer-specific contacts, more particularly irrespective of production tolerances of the cartridge. As a result, it is solely the play between the width of the plate, on the one hand, and the width of the associated guideway in the printer, on the other hand, that is crucial. The mounting of the plate is so arranged that the latter can be displaced slightly to both sides, that is to say transversely to the cartridge insertion direction or, that is, transversely to the longitudinal extent of the associated cartridge wall, especially the end wall.

In order to additionally facilitate the self-adjustment of the plate, at least the bottom corners of the plate are slightly bevelled off. This applies especially to plates having a rectangular outline.

Furthermore, the electrical contacts on the plate are constructed in strip form in the insertion direction so that any production tolerances in the insertion direction can also be compensated. In this manner it is ensured that the ink cartridge reliably makes contact even without latching hooks. The electrical contact strips are so narrow that it is not possible for the electronics to allow an electrical connection to be made at an incorrect height with an incorrect contact in the printer or in the cartridge receptacle.

BRIEF DESCRIPTION OF THE DRAWINGS

A preferred embodiment of an ink cartridge constructed in accordance with the invention is explained below in greater detail with reference to the accompanying drawings, in which.

DETAILED DESCRIPTION OF THE PREFERRED EMBODIMENTS

Figure 1:
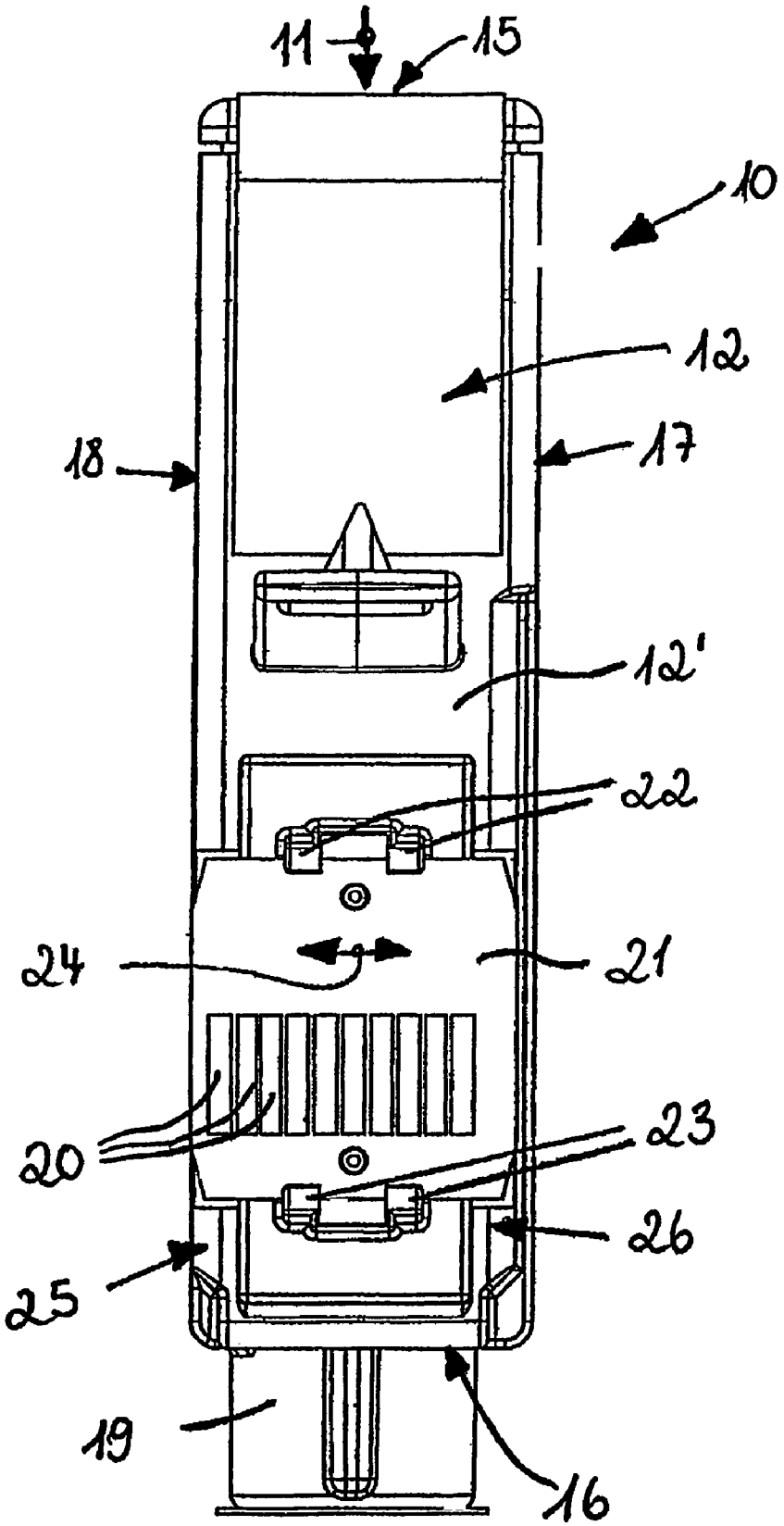
FIG. 1 is a front view of an ink cartridge constructed in accordance with the invention.
Figures 2, 3:
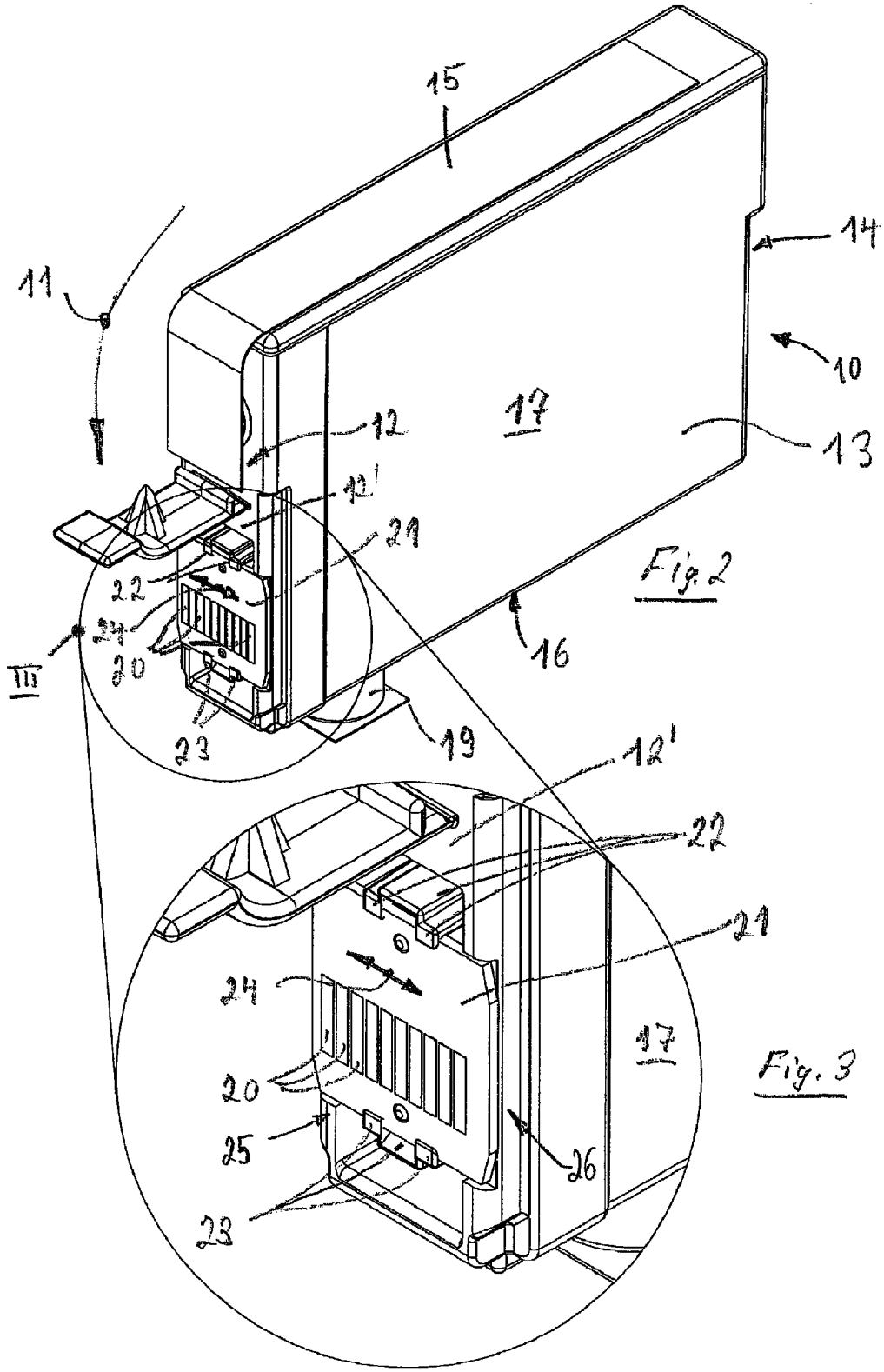
FIG. 2 is a perspective view, from the front and at an angle from above, of the ink cartridge according to FIG. 1.
FIG. 3 is the detail III, at an enlarged scale, taken from FIG. 2.

The ink cartridge 10 in FIGS. 1 and 2 is insertable in an inkjet printer, or cartridge receptacle associated therewith, more particularly in the direction of arrow 11 in FIG. 2. This insertion direction 11 extends, at least in the final phase, approximately parallel to the longitudinal extent of the front end wall 12 of a housing 13 defining the ink cartridge. This housing 13 further comprises, in addition to the front end wall 12, a rear end wall 14 extending parallel thereto, a top 15, a base 16 and two flat side walls 17, 18. Within the housing there is formed an ink chamber (not shown here in detail). In addition there can be provided a ventilation chamber and an ink storage chamber having an ink storage element. These are found in the prior art and are therefore not described here in detail. The same also applies to the connection port 19 formed in the base 16 for establishing a fluid connection between the ink chamber formed within the housing 13 and a supply connection provided at the ink jet printer.

This too is a feature known per se.

As can be seen from FIGS. 1 and 2, as well as FIG. 3, on the front end wall 12 there is arranged a plate 21 comprising electrical contacts 20 and also an element (not shown in detail) for storage of cartridge-specific and/or printer-specific data. In the region of, that is to say in the lower half of, the front end wall 12, the latter is of slightly narrower construction than the plate 21. That narrower region of the front end wall 12 is indicated by the reference numeral 12'. That portion 12' of the front end wall 12 has top and bottom holding elements 22 and 23 respectively, between which the plate 21 is held so as to allow reciprocating displacement transversely to the longitudinal extent of the end wall, or transversely to the cartridge insertion direction 11. This transversely displaceable mounting of the plate 21 is indicated in FIG. 1 by the double-headed arrow 24. In the embodiment shown, the top and bottom holding elements are hook elements which engage around the top and bottom edges of the plate 21. The plate 21 itself is of approximately rectangular shape, with all four corners being bevelled off in order to facilitate the self-adjustment of the plate when the cartridge is inserted in the associated receptacle.

The electrical contacts, or contact strips 20, arranged on that side of the plate which is remote from the cartridge 10 extend parallel to one another and parallel to the longitudinal extent of the associated end wall 12, or parallel to the insertion direction 11. They are made so long that an electrical contact is ensured even without latching of the cartridge within the receptacle, and more particularly even when the contacts associated with the printer, or cartridge receptacle, are offset relative to one another in terms of their height.

Because of the transverse displaceability of the plate 21 bearing the electrical contacts, it is no longer necessary for the ink cartridge to be manufactured exactly, at least in terms of its width. It is also possible for ink cartridges which do have larger manufacturing tolerances to be used. When the ink cartridge is inserted into the associated receptacle, the plate 21 automatically moves into the correct position.

It is also further feasible for at least the bottom corners of the plate 21 to be additionally rounded off in order, as a result, to facilitate the self-adjustment of the plate 21.

The smaller width, compared to the plate 21, of that region 12' of the front end wall 12 which is associated with the plate 21 is achieved, for example, as in the embodiment shown, by means of the fact that the longitudinal borders 25, 26 are moved to the inside, that is to say set in. This ensures that the two longitudinal edges of the plate 21 project laterally beyond the mentioned longitudinal borders 25, 26. It is accordingly ensured that, when the cartridge is inserted in the cartridge receptacle in the direction of the arrow 11 on the front end wall 12 first the plate 21 comes into engagement with the associated guideway of the cartridge receptacle and, by itself, aligns itself with respect thereto in such a way that the cartridge-specific contacts 20 come into connection with the associated printer-specific contacts.

All features disclosed in the application may be used alone or in combination, and the invention is not limited to the specific preferred embodiment that is disclosed.

REFERENCE NUMERALS

10 ink cartridge
11 insertion direction
12 front end wall
12' lower half of front end wall
13 housing
14 rear end wall
15 top, or top wall
16 base, or base wall
17 side wall
18 side wall
19 connection port
20 electrical contacts
21 plate
22 top holding elements
23 bottom holding elements
24 double-headed arrow
25 longitudinal border
26 longitudinal border

The invention claimed is:

1. Ink cartridge (10) which is insertable into an inkjet printer or a cartridge receptacle associated therewith, said ink cartridge (10) comprising a housing (13) delimited by two side walls (17, 18), a top wall (15), a base wall (16) and front (12) and rear (14) end walls, on at least one of the end walls (12) there is arranged a plate (21) comprising electrical contacts (20) and an element for storage of cartridge-specific and/or printer-specific data, wherein the plate (21) is movably mounted to allow movement transversely to a longitudinal extent thereof with the longitudinal extent of the plate corresponding to an insertion direction (11) of the cartridge (10), and the plate (21), in a direction transverse to the longitudinal extent thereof, is wider than an associated portion (12') of said at least one of the end walls (12).

2. Ink cartridge according to claim 1, wherein the plate (21) is held between top (22) and bottom (23) holding elements on said at least one of the end walls (12) so as to allow reciprocating displacement transversely to a longitudinal extent of the end wall.

3. Ink cartridge according to claim 1, wherein the plate (21) is of approximately rectangular shape, with at least two bottom corners thereof being bevelled off.

4. Ink cartridge according to claim 1, wherein the plate (21) has, on a side remote from the cartridge (10), at least one contact (20) that extends parallel to a longitudinal extent of said at least one of the end walls (12).

5. Ink cartridge according to claim 1, wherein the plate (21) has, on a side remote from the cartridge (10), a plurality of contacts (20) that extend parallel to one another and parallel to a longitudinal extent of said at least one of the end walls (12).

* * * * *